US009746201B2

(12) United States Patent
Miyazaki

(10) Patent No.: US 9,746,201 B2
(45) Date of Patent: Aug. 29, 2017

(54) COMBUSTION APPARATUS

(71) Applicant: RINNAI CORPORATION, Nagoya-shi, Aichi (JP)

(72) Inventor: Yuya Miyazaki, Nagoya (JP)

(73) Assignee: RINNAI CORPORATION, Nagoya-Shi, Aichi (JP)

( * ) Notice: Subject to any disclaimer, the term of this patent is extended or adjusted under 35 U.S.C. 154(b) by 127 days.

(21) Appl. No.: 14/826,136

(22) Filed: Aug. 13, 2015

(65) Prior Publication Data

US 2017/0045262 A1 Feb. 16, 2017

(51) Int. Cl.

| | |
|---|---|
| ***F02C 7/08*** | (2006.01) |
| ***F24H 1/14*** | (2006.01) |
| ***F24H 9/18*** | (2006.01) |

(52) U.S. Cl.

CPC ..... *F24H 1/145* (2013.01); *F24H 9/1836* (2013.01)

(58) Field of Classification Search

CPC ..... F02C 7/08; F02D 2200/0414

USPC ..... 122/1 A, 5.51, 70, 225 F, 31.1; 126/250, 126/101, 99 R, 110 AA, 117, 106; 432/196, 201, 219

See application file for complete search history.

(56) References Cited

U.S. PATENT DOCUMENTS

| | | | | |
|---|---|---|---|---|
| 3,656,470 A * | 4/1972 | Goodgion | F24H 3/065 | 126/110 AA |
| 4,047,490 A * | 9/1977 | Galluzzo | F24B 7/005 | 110/304 |
| 4,256,082 A * | 3/1981 | Scholten | F24H 3/087 | 110/323 |
| 4,373,453 A * | 2/1983 | Foresto | F23G 5/46 | 110/216 |

(Continued)

FOREIGN PATENT DOCUMENTS

| | | |
|---|---|---|
| JP | S61-048243 | 4/1986 |
| JP | S61-043085 | 12/1986 |
| JP | H02-092444 | 7/1990 |

(Continued)

OTHER PUBLICATIONS

Japanese Office Action dated Apr. 19, 2016, Japanese Patent Application No. 2014-059845.

(Continued)

*Primary Examiner* — Gregory A Wilson

(74) *Attorney, Agent, or Firm* — Vierra Magen Marcus LLP

(57) ABSTRACT

The present application discloses a combustion apparatus including: an air supply/exhaust port formed such that an air supply passage surrounds the outside of an exhaust passage; and an air supply port in which an air supply passage is formed. This combustion apparatus is configured such that in a case where this apparatus is installed in the double-pipe system, the air supply passage of the air supply port is (Continued)

closed, whereas in a case where it is installed in the separate-pipe system, the air supply passage of the air supply/exhaust port is closed. The combustion apparatus includes: a supplied-air temperature sensor; and a guide member, which is located near the air supply passage of the air supply/exhaust port or the air supply passage of the air supply port, and by which air flowing into the space in the housing is guided to the supplied-air temperature sensor.

4 Claims, 6 Drawing Sheets

(56) References Cited

U.S. PATENT DOCUMENTS 4,909,190 A * 3/1990 Finch ..... F23L 15/02
122/1 A

FOREIGN PATENT DOCUMENTS

| | | |
|---|---|---|
| JP | H04-025945 | 3/1992 |
| JP | 2000171100 | 6/2000 |
| JP | 2001-235144 | 8/2001 |
| JP | 2004-163058 | 6/2004 |
| JP | 2010281495 | 12/2010 |
| JP | 2013-127339 | 6/2013 |
| JP | 2014-040956 | 6/2014 |

OTHER PUBLICATIONS

Machine translation prepared by the Japanese Patent Office and English Translation of Abstract of Japanese Patent Application No. JP2014-040956.
Machine translation prepared by the Japanese Patent Office and English Translation of Abstract of Japanese Application Patent No. JP2013-127339.
Machine translation prepared by the Japanese Patent Office and English Translation of Abstract of Japanese Patent Application No. JP2001-235144.
Machine translation prepared by the Japanese Patent Office of Japanese Patent Application No. JPS61-043085.
Machine translation prepared by the Japanese Patent Office of Japanese Patent Application No. JPH02-092444.
Machine translation prepared by the Japanese Patent Office of Japanese Patent Application No. JPH04-025945.
Machine translation prepared by the Japanese Patent Office and English Translation of Abstract of Japanese Patent Application No. JP2004-163058.
English Abstract of Japanese Patent Application No. JP2000171100.
Machine Translation prepared by the Japanese Patent Office of Japanese Patent Application No. JP2000171100.
English Abstract of Japanese Patent Application No. JP2010281495.
Machine Translation prepared by the Japanese Patent Office of Japanese Patent Application No. JP2010281495.

* cited by examiner

COMBUSTION APPARATUS

TECHNICAL FIELD

The present application relates to combustion apparatuses.

DESCRIPTION OF RELATED ART

JP 61-48243 Y discloses a combustion apparatus that can selectively be installed in a double-pipe system using a double pipe in which an exhaust pipe is accommodated in an air supply pipe or in a separate-pipe system using an exhaust pipe and an air supply pipe separately. This combustion apparatus includes: an air supply/exhaust port formed such that an air supply passage surrounds the outside of an exhaust passage; and an air supply port in which an air supply passage is formed. Both the air supply passage of the air supply/exhaust port and the air supply passage of the air supply port communicate with the space in a housing. This combustion apparatus is configured such that in a case where this apparatus is installed in the double-pipe system, the air supply passage of the air supply port is closed, and in a case where it is installed in the separate-pipe system, the air supply passage of the air supply/exhaust port is closed.

BRIEF SUMMARY OF INVENTION

There is a case where a combustion apparatus has in its housing a supplied-air temperature sensor for measuring the temperature of supplied air. The space in the housing has areas where air stays easily and areas where air does not stay easily. There are cases where the temperature of air staying within the housing and the temperature of air that has flowed into the housing from the air supply passage of the air supply/exhaust port or the air supply passage of the air supply port significantly differ from each other. Therefore, when the temperature of supplied air is measured by the supplied-air temperature sensor, not the temperature of air staying within the housing but the temperature of air that has flowed into the housing from the air supply passage of an air supply/exhaust port or the air supply passage of an air supply port has to be measured accurately.

In the technique disclosed in JP 61-48243 Y, there is a difference in the flow of air into the housing between the case where the combustion apparatus is installed in the double-pipe system and the case where it is installed in the separate-pipe system. Therefore, even in the case where a single supplied-air temperature sensor is disposed so as to accurately measure the temperature of supplied air in the combustion apparatus installed in either one of the double-pipe system and separate-pipe system, it has been difficult for this sensor to accurately measure the temperature of supplied air in the combustion apparatus installed in the other of the systems. In a case where a combustion apparatus is installed in the double-pipe system as well as in a case where it is installed in the separate-pipe system, it has been hoped that a technique enabling accurate measurement of the temperature of supplied air by use of a single supplied-air temperature sensor may be provided.

The present application discloses a combustion apparatus that can selectively be installed in a double-pipe system using a double pipe in which an exhaust pipe is accommodated in an air supply pipe or in a separate-pipe system using an exhaust pipe and an air supply pipe separately. This combustion apparatus includes: an air supply/exhaust port formed such that an air supply passage surrounds the outside of an exhaust passage; and an air supply port in which an air supply passage is formed. In the combustion apparatus, both the air supply passage of the air supply/exhaust port and the air supply passage of the air supply port communicate with the space in a housing. This combustion apparatus is configured such that in a case where this apparatus is installed in the double-pipe system, the air supply passage of the air supply port is closed, whereas in a case where it is installed in the separate-pipe system, the air supply passage of the air supply/exhaust port is closed. The combustion apparatus includes: a supplied-air temperature sensor that measures, in the space in the housing, the temperature of supplied air, and a guide member, which is located near the air supply passage of the air supply/exhaust port or the air supply passage of the air supply port, and by which air flowing into the space in the housing from the air supply passage of the air supply/exhaust port or from the air supply passage of the air supply port is guided to the supplied-air temperature sensor.

According to the foregoing combustion apparatus, air flowing into the space in the housing from the air supply passage of the air supply/exhaust port or the air supply passage of the air supply port is guided to the supplied-air temperature sensor by the guide member, thus making it possible to accurately measure the temperature of supplied air. In a case where the combustion apparatus is installed in the double-pipe system as well as in a case where it is installed in the separate-pipe system, the temperature of supplied air can accurately be measured by use of a single supplied-air temperature sensor.

According to the combustion apparatus disclosed in the present application, the temperature of supplied air can accurately be measured by use of a single supplied-air temperature sensor in a case where the combustion apparatus is installed in the double-pipe system as well as in a case where it is installed in the separate-pipe system.

DETAILED DESCRIPTION OF INVENTION

In the combustion apparatus, the supplied-air temperature sensor may be disposed near either one of the air supply passage of the air supply/exhaust port and the air supply passage of the air supply port, and the guide member may be disposed near the other of the air supply passage of the air supply/exhaust port and the air supply passage of the air supply port.

According to the foregoing combustion apparatus, the supplied-air temperature sensor is disposed near either one of the air supply passage of the air supply/exhaust port and the air supply passage of the air supply port, and air supplied from the other air supply passage is guided to the supplied-air temperature sensor by the guide member. Accordingly, the temperature of the supplied air can accurately be measured without disposing guide members near both the air supply passage of the air supply/exhaust port and the air supply passage of the air supply port. Thus, the number of components can be reduced.

The combustion apparatus may be configured such that the supplied-air temperature sensor is disposed near the air supply passage of the air supply/exhaust port, and the guide member is disposed near the air supply passage of the air supply port.

If the guide member is disposed near the air supply passage of the air supply/exhaust port, the guide member has to be formed in a shape that does not interfere with the exhaust passage, by surrounding the exhaust passage of the air supply/exhaust port, which results in a manufacturing cost increase. Disposing the guide member near the air supply passage of the air supply port as in the foregoing combustion apparatus makes it possible to form the guide member in a simple shape, thus reducing the manufacturing cost.

The combustion apparatus may be configured such that the guide member includes: a bottom plate portion that blocks straight movement of air flowing into the space in the housing from the air supply passage of the air supply/exhaust port or from the air supply passage of the air supply port; and wall plate portions bent from the peripheral edges of the bottom plate portion, and one of the wall plate portions has a hole or notch for guiding air to the supplied-air temperature sensor.

According to the foregoing combustion apparatus, air flowing into the space in the housing from the air supply passage of the air supply/exhaust port or the air supply passage of the air supply port can securely be guided to the supplied-air temperature sensor.

The combustion apparatus may be configured such that holes or notches for circulating air are formed around the entire periphery of the wall plate portions.

According to the foregoing combustion apparatus, a required air supply area can be ensured. Additionally, air is circulated throughout the space in the housing, thus making it possible to cool compositional elements accommodated in the housing.

Embodiment 1

Figure 1:
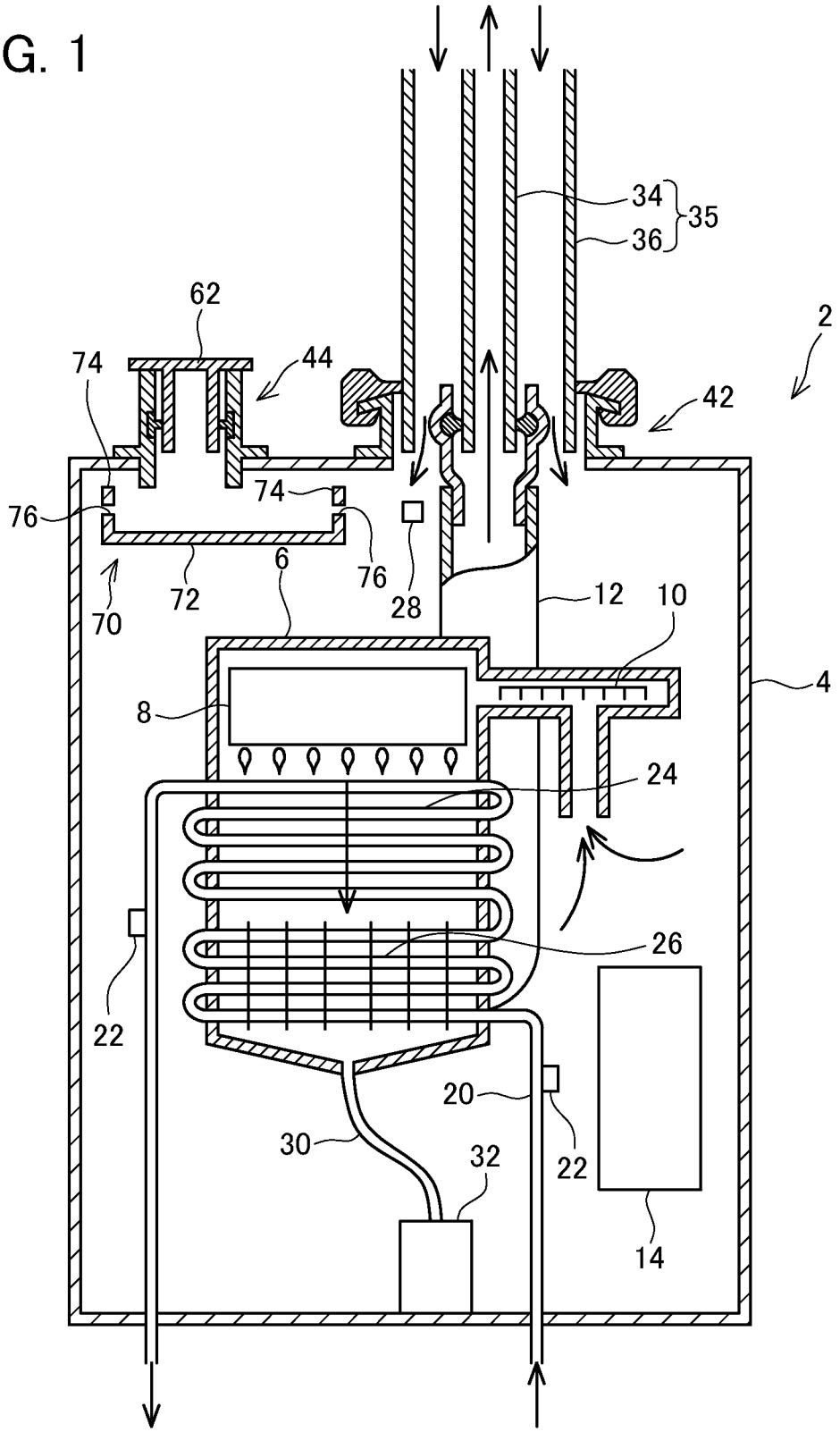
FIG. 1 is a schematic sectional view showing a state in which a combustion apparatus 2 according to Embodiment 1 is installed in a double-pipe system.
Figure 2:
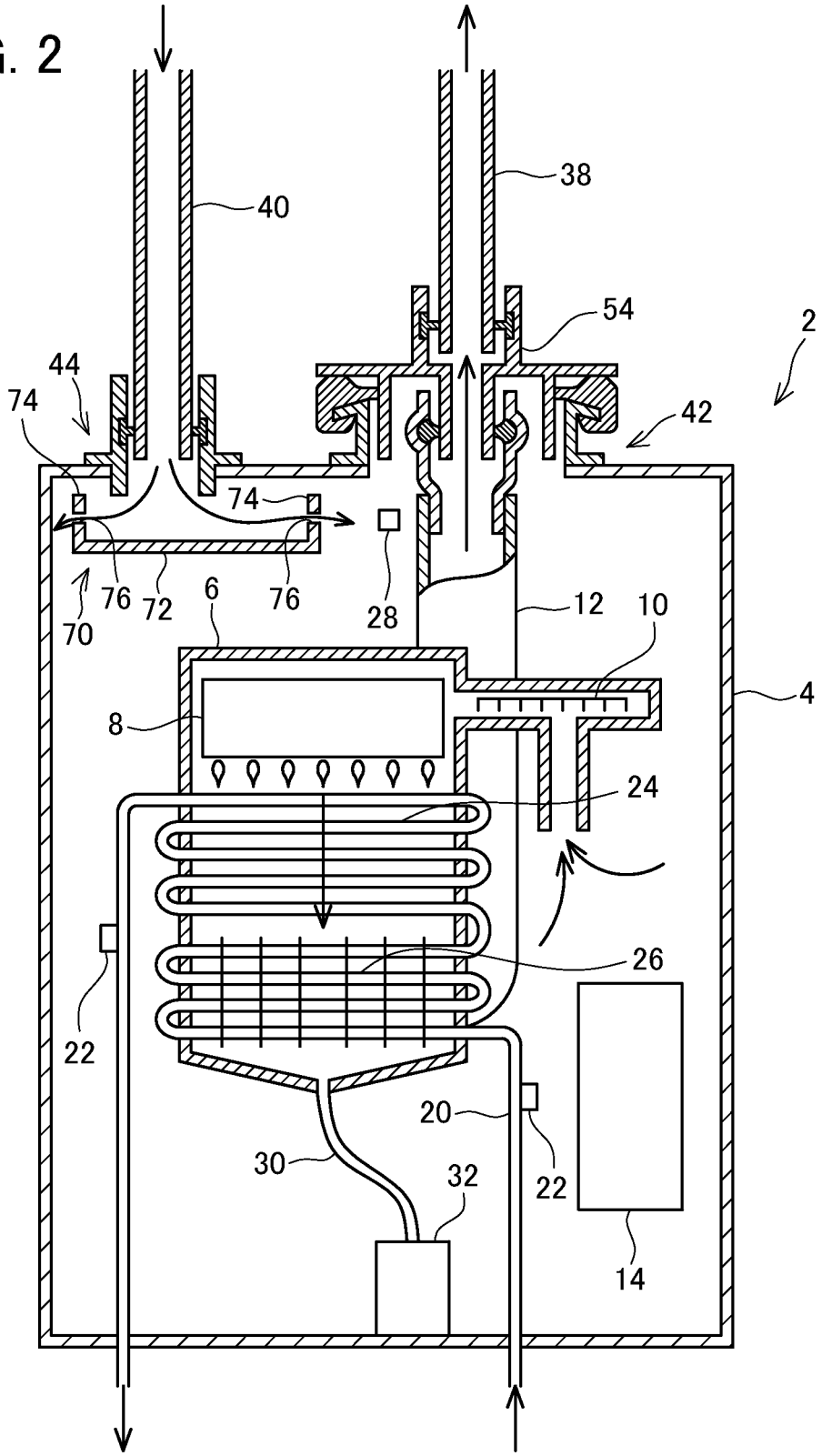
FIG. 2 is a schematic sectional view showing a state in which a combustion apparatus 2 according to Embodiment 1 is installed in a separate-pipe system.

As shown in FIGS. 1 and 2, a combustion apparatus 2 according to the present embodiment accommodates a combustion chamber 6 in a housing 4. A burner 8 is accommodated in the combustion chamber 6. Fuel gas is supplied to the burner 8 from a fuel supply pipe, not shown. The burner 8 is disposed so as to discharge combustion gas downward. Air in the housing 4 is supplied to the upper part of the combustion chamber 6 by a fan 10. When combustion takes place in the burner 8, combustion gas flows from the upper part of the combustion chamber 6 to the lower part thereof. The lower part of the combustion chamber 6 communicates with an exhaust cylinder 12. Combustion gas that has reached the lower part of the combustion chamber 6 flows in the exhaust cylinder 12 from its lower part to upper part and is discharged out of the combustion apparatus 2.

The combustion apparatus 2 includes a water pipe 20. The water pipe 20 is disposed so as to pass through the combustion chamber 6. The portion passing through the combustion chamber 6 of the water pipe 20 has a main heat exchange part 24 and latent-heat exchange part 26. In the main heat exchange part 24, sensible-heat exchange takes place between combustion gas flowing outside the water pipe 20 and water flowing in the water pipe 20. In the latent-heat exchange part 26, sensible-heat exchange and latent-heat exchange take place between combustion gas flowing outside the water pipe 20 and water flowing in the water pipe 20. A drain tube 30 for discharging drainage that occurs in the latent-heat exchange part 26 is connected to the lowermost part of the combustion chamber 6. The drain tube 30 is connected to a drain container 32 for holding drainage therein. Additionally, also accommodated in the housing 4 is, for example, a circuit board 14, which controls operations of various compositional elements of the combustion apparatus 2.

The top of the housing 4 of the combustion apparatus 2 has an air supply/exhaust port 42 and an air supply port 44. Formed in the air supply/exhaust port 42 are an exhaust passage and an air supply passage surrounding the outside of the exhaust passage. Formed in the air supply port 44 is another air supply passage. Both the air supply passage of the air supply/exhaust port 42 and the air supply passage of the air supply port 44 communicate with the space in the housing 4.

The combustion apparatus 2 can be installed, as shown in FIG. 1, in a double-pipe system using a double pipe 35 in which an exhaust pipe 34 is accommodated in an air supply pipe 36, or can be installed, as shown in FIG. 2, in a separate-pipe system using an exhaust pipe 38 and an air supply pipe 40 separate from each other.

In a case where the combustion apparatus 2 is installed in the double-pipe system shown in FIG. 1, the double pipe 35 is mounted in the air supply/exhaust port 42. Air from the air supply pipe 36 is introduced into the space in the housing 4 via the air supply/exhaust port 42, and exhaust gas from the exhaust cylinder 12 is drawn out to the exhaust pipe 34 via the air supply/exhaust port 42. In this case, a cap 62 is attached to the air supply port 44 to close the air supply passage of the air supply port 44.

In a case where the combustion apparatus 2 is installed in the separate-pipe system, shown in FIG. 2, the air supply pipe 40 is mounted in the air supply port 44 whereas the exhaust pipe 38 is mounted in the air supply/exhaust port 42. Air from the air supply pipe 40 is introduced into the space in the housing 4 via the air supply port 44, and exhaust gas from the exhaust cylinder 12 is drawn out to the exhaust pipe 38 via the air supply/exhaust port 42. In this case, a ring cap 54 is attached to the air supply/exhaust port 42 to close the air supply passage of the air supply/exhaust port 42.

The combustion apparatus 2 includes a supplied-air temperature sensor 28 and heaters 22. The supplied-air temperature sensor 28 measures the temperature of supplied air in the space in the housing 4. The heaters 22 are provided at a plurality of points along the water pipe 20. When the supplied air temperature measured by the supplied-air temperature sensor 28 is not higher than a predetermined temperature, the combustion apparatus 2 heats the water pipe 20 by means of the heater 22, thereby preventing water in the water pipe 20 from freezing.

The space in the housing 4 has areas where air stays easily and areas where air does not stay easily. There are cases where the temperature of air staying within the housing 4 and the temperature of air that has flowed into the housing 4 from the air supply passage of the air supply/exhaust port 42 or the air supply passage of the air supply port 44 significantly differ from each other. Therefore, measuring the temperature of supplied air by means of the supplied-air temperature sensor 28 is required to accurately measure not the temperature of air staying within the housing 4 but the temperature of air that has flowed into the housing 4 from the air supply passage of the air supply/exhaust port 42 or the air supply passage of the air supply port 44.

In the combustion apparatus 2 according to the present embodiment, the supplied-air temperature sensor 28 is located near the air supply passage of the air supply/exhaust port 42. By virtue of such a configuration, in a case where the combustion apparatus 2 is installed in the double-pipe system shown in FIG. 1, air that has flowed into the housing 4 from the air supply passage of the air supply/exhaust port 42 passes the supplied-air temperature sensor 28. Accordingly, the supplied-air temperature sensor 28 enables accurate measurement of the temperature of air that has flowed into the housing 4 from the air supply passage of the air supply/exhaust port 42.

Additionally, the combustion apparatus 2 of the present embodiment has, near the air supply passage of the air supply port 44, a guide member 70 by which air that has flowed into the space in the housing 4 is guided to the supplied-air temperature sensor 28. The guide member 70, which is formed by sheet metal working, includes: a bottom plate portion 72 for blocking straight movement of air flowing into the space in the housing 4 from the air supply passage of the air supply port 44; and wall plate portions 74 bent from the peripheral edges of the bottom plate portion 72. Formed in part of the wall plate portions 74 near the supplied-air temperature sensor 28 is a hole 76 by which air flowing into the housing 4 from the air supply passage in the air supply port 44 is guided to the supplied-air temperature sensor 28. By virtue of such a configuration, in a case where the combustion apparatus 2 is installed in the separate-pipe system shown in FIG. 2, air that has flowed into the housing 4 from the air supply passage of the air supply port 44 is guided by the guide member 70 and passes the supplied-air temperature sensor 28. Accordingly, the supplied-air temperature sensor 28 enables accurate measurement of the temperature of air that has flowed into the housing 4 from the air supply passage of the air supply port 44.

As described above, according to the combustion apparatus 2 of the present embodiment, the arrangement of the supplied-air temperature sensor 28 near the air supply passage of the air supply/exhaust port 42 and the arrangement of the guide member 70 near the air supply passage of the air supply port 44 make it possible to accurately measure the temperature of supplied air by means of the single supplied-air temperature sensor 28 both in the cases where the combustion apparatus 2 is installed in the double-pipe system shown in FIG. 1 and where it is installed in the separate-pipe system shown in FIG. 2.

In the combustion apparatus 2 of the present embodiment, in addition to the part of the wall plate portions 74 of the guide member 70 near the supplied-air temperature sensor 28, holes 76 for circulating air are formed around the entire periphery of the wall plate portions 74. Such a configuration makes it possible to ensure an area for supplied air, as required in a case where the combustion apparatus 2 is installed in the separate-pipe system shown in FIG. 2. Additionally, in a case where the combustion apparatus 2 is installed in the separate-pipe system shown in FIG. 2, air is circulated throughout the space in the housing 4, thus enabling cooling of compositional elements accommodated in the housing 4.

Instead of forming the holes 76 in the wall plate portions 74 of the guide member 70, notches may be formed therein.

In the combustion apparatus 2 according to the present embodiment, the supplied-air temperature sensor 28 is disposed near the air supply passage of the air supply/exhaust port 42. Such a configuration makes it possible to accurately measure the temperature of supplied air by means of the supplied-air temperature sensor 28 without providing a guide member near the air supply/exhaust port 42, in a case where the combustion apparatus 2 is installed in the double-pipe system shown in FIG. 1.

In the combustion apparatus 2 according to the present embodiment, the guide member 70 is disposed near the air supply passage of the air supply port 44. If the guide member is disposed near the air supply passage of the air supply/exhaust port 42, the guide member has to be formed in a shape that does not interfere with the exhaust cylinder 12 communicating with the exhaust passage of the air supply/exhaust port 42, resulting in a manufacturing cost increase. By disposing the guide member 70 near the air supply passage of the air supply port 44 as in the combustion apparatus 2 of the present embodiment, the guide member 70 can be formed in a simple shape, thus enabling a manufacturing cost decrease.

Embodiment 2

Figure 3:
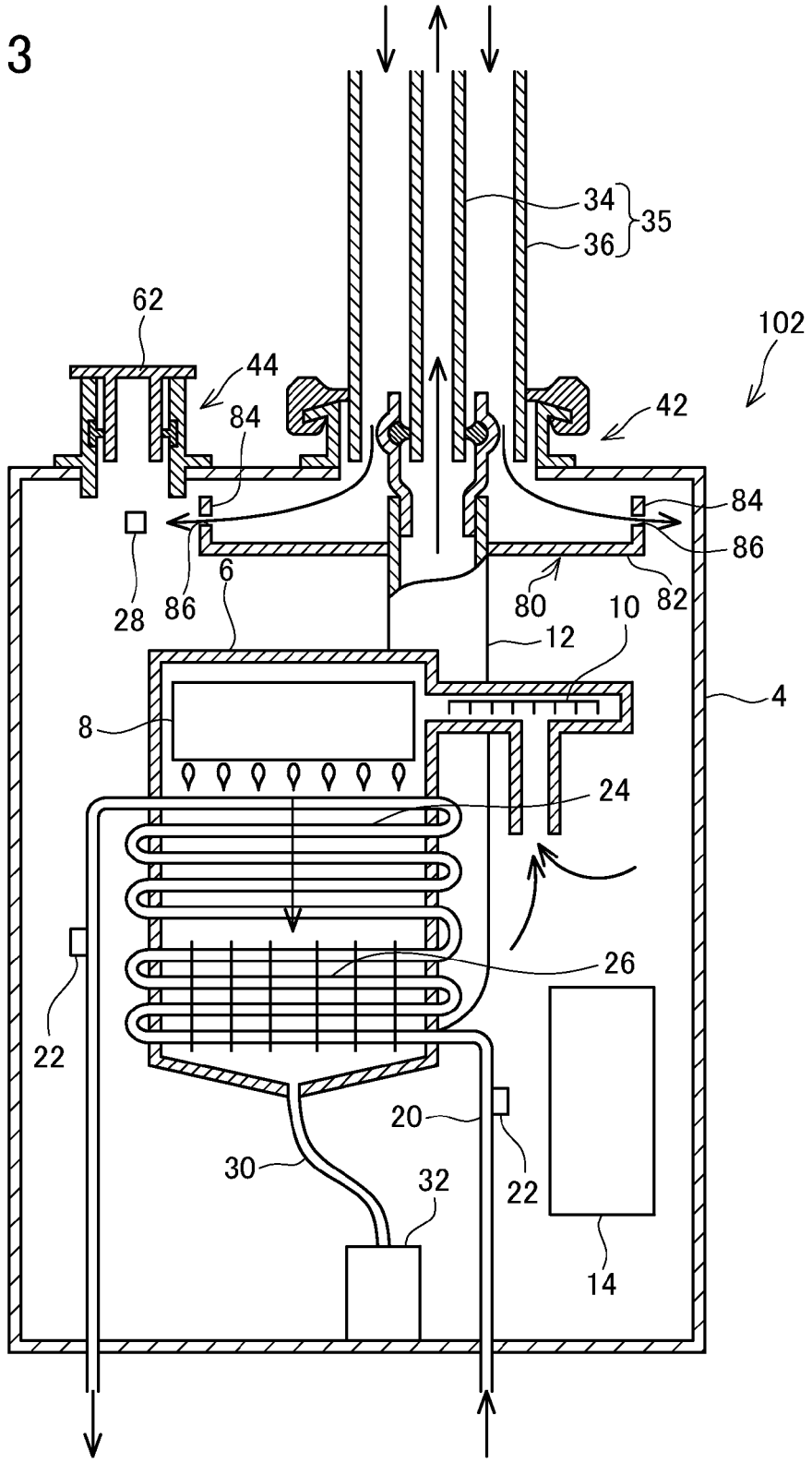
FIG. 3 is a schematic sectional view showing a state in which a combustion apparatus 102 according to Embodiment 2 is installed in a double-pipe system.
Figure 4:
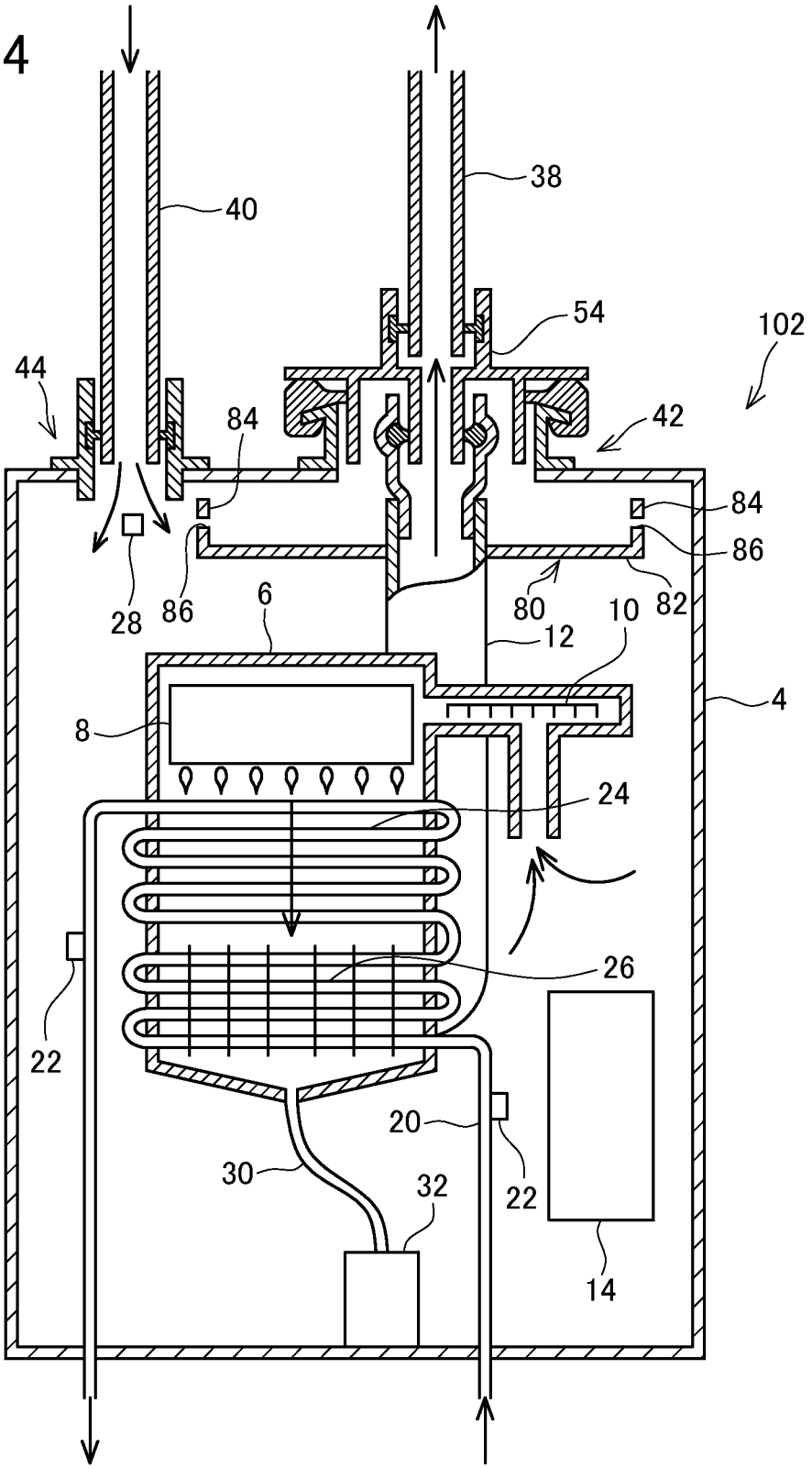
FIG. 4 is a schematic sectional view showing a state in which a combustion apparatus 102 according to Embodiment 2 is installed in a separate-pipe system.

Referring to FIGS. 3 and 4, a combustion apparatus 102 according to Embodiment 2 will be described. The combustion apparatus 102 in the present embodiment is substantially identical to the combustion apparatus 2 in Embodiment 1 in configuration. The description below will focus on the differences between the combustion apparatus 102 in the present embodiment and the combustion apparatus 2 in Embodiment 1.

In the combustion apparatus 102 according to the present embodiment, a supplied-air temperature sensor 28 is disposed near the air supply passage of an air supply port 44 whereas a guide member 80 is disposed near the air supply passage of an air supply/exhaust port 42. The guide member 80 includes a bottom plate portion 82 and wall plate portions 84. The wall plate portions 84 have holes 86 for circulating air. Additionally, a through-hole is formed in the bottom plate portion 82, and an exhaust cylinder 12 communicating with the exhaust passage of the air supply/exhaust port 42 passes through this hole.

In the combustion apparatus 102 according to the present embodiment, the supplied-air temperature sensor 28 is located near the air supply passage of the air supply port 44. By virtue of such a configuration, in a case where the combustion apparatus 102 is installed in the separate-pipe system shown in FIG. 4, air that has flowed into a housing 4 from the air supply passage of the air supply port 44 passes the supplied-air temperature sensor 28. Accordingly, the supplied-air temperature sensor 28 enables accurate measurement of the temperature of air that has flowed into the housing 4 from the air supply passage of the air supply port 44.

In the combustion apparatus 102 according to the present embodiment, the guide member 80 is disposed near the air supply passage of the air supply/exhaust port 42. By virtue of such a configuration, in a case where the combustion apparatus 102 is installed in the double-pipe system shown in FIG. 3, air that has flowed into the housing 4 from the air supply passage of the air supply/exhaust port 42 is guided by the guide member 80 and passes the supplied-air temperature sensor 28. Accordingly, the supplied-air temperature sensor 28 enables accurate measurement of the temperature of air that has flowed into the housing 4 from the air supply passage of the air supply/exhaust port 42.

As described above, according to the combustion apparatus 102 of the present embodiment, the arrangement of the supplied-air temperature sensor 28 near the air supply passage of the air supply port 44 and the arrangement of the guide member 80 near the air supply passage of the air supply/exhaust port 42 make it possible to accurately measure the temperature of supplied air by means of the single supplied-air temperature sensor 28 both in the cases where the combustion apparatus 102 is installed in the double-pipe system shown in FIG. 3 and where it is installed in the separate-pipe system shown in FIG. 4.

In the combustion apparatus 102 according to the present embodiment, the supplied-air temperature sensor 28 is disposed near the air supply passage of the air supply port 44. Such a configuration makes it possible to accurately measure the temperature of supplied air by means of the supplied-air temperature sensor 28 without providing a guide member near the air supply port 44, in a case where the combustion apparatus 102 is installed in the separate-pipe system shown in FIG. 4.

Embodiment 3

Figure 5:
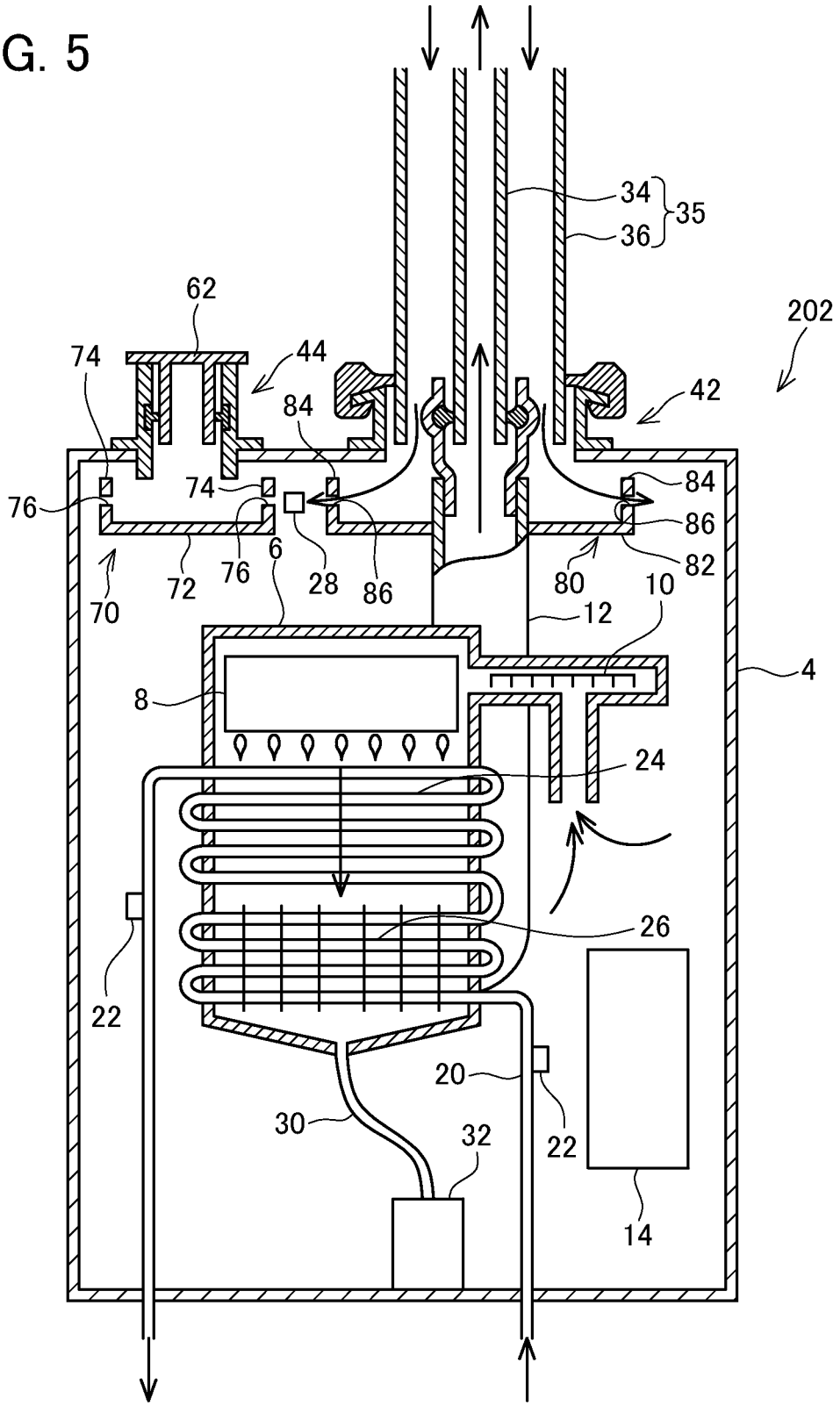
FIG. 5 is a schematic sectional view showing a state in which a combustion apparatus 202 according to Embodiment 3 is installed in a double-pipe system.
Figure 6:
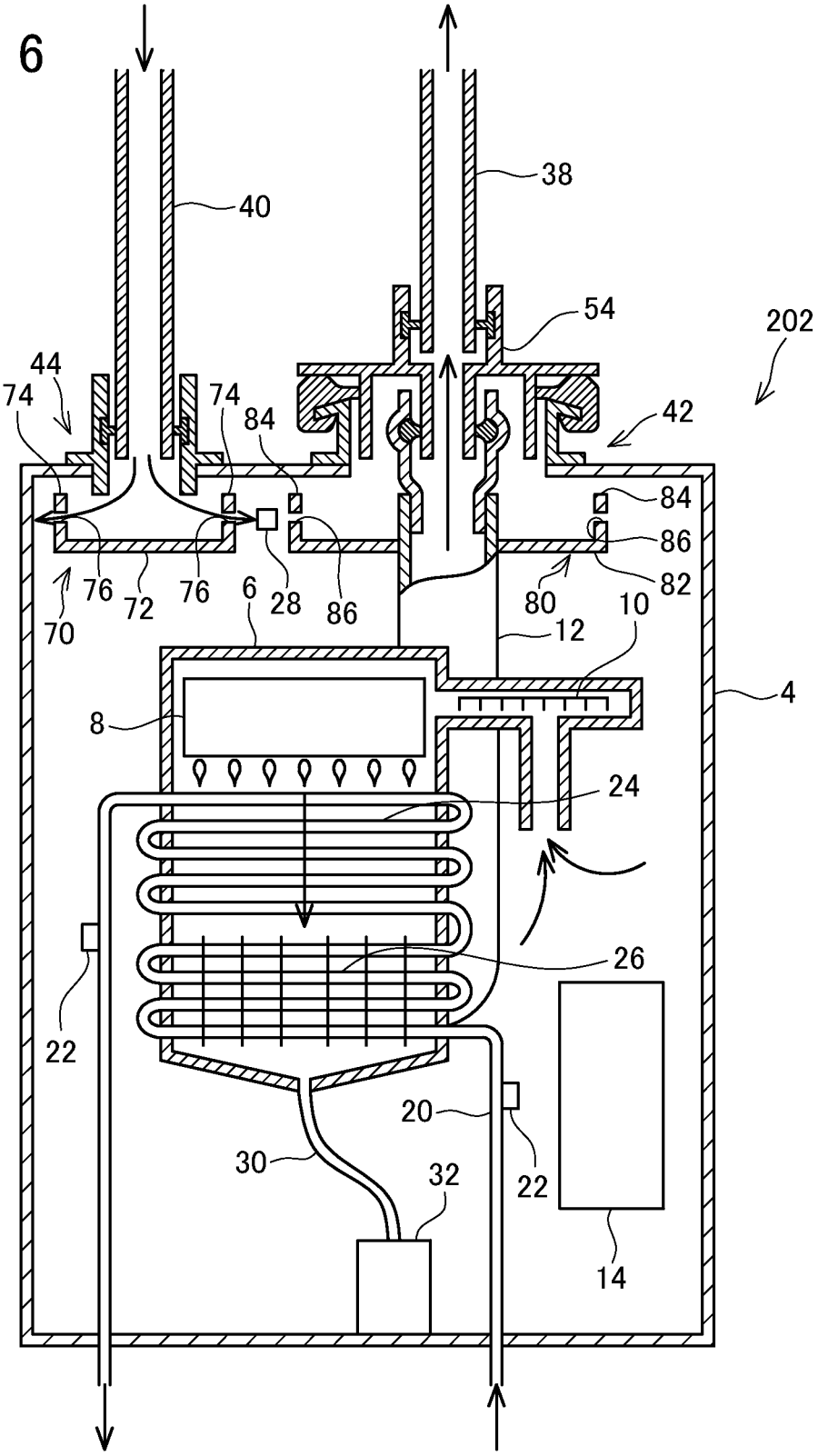
FIG. 6 is a schematic sectional view showing a state in which a combustion apparatus 202 according to Embodiment 3 is installed in a separate-pipe system.

Referring to FIGS. 5 and 6, a combustion apparatus 202 according to Embodiment 3 will be described. The combustion apparatus 202 in the present embodiment is substantially identical to the combustion apparatuses 2, 102 in Embodiments 1 and 2 respectively in configuration. The description below will focus on the differences between the combustion apparatus 202 in the present embodiment and the combustion apparatuses 2, 102 in Embodiments 1 and 2.

In the combustion apparatus 202 according to the present embodiment, a supplied-air temperature sensor 28 is disposed intermediate between the air supply passage of an air supply/exhaust port 42 and the air supply passage of an air supply port 44. Guide members 70, 80 are disposed near the air supply passage of the air supply port 44 and the air supply passage of the air supply/exhaust port 42, respectively.

In the combustion apparatus 202 according to the present embodiment, the guide member 70 is disposed near the air supply passage of the air supply port 44. By virtue of such a configuration, in a case where the combustion apparatus 202 is installed in the separate-pipe system shown in FIG. 6, air that has flowed into the housing 4 from the air supply passage of the air supply port 44 is guided by the guide member 70 and passes the supplied-air temperature sensor 28. Accordingly, the supplied-air temperature sensor 28 enables accurate measurement of the temperature of air that has flowed into the housing 4 from the air supply passage of the air supply port 44.

Additionally, in the combustion apparatus 202 according to the present embodiment, the guide member 80 is disposed near the air supply passage of the air supply/exhaust port 42. By virtue of such a configuration, in a case where the combustion apparatus 202 is installed in the double-pipe system shown in FIG. 5, air that has flowed into the housing 4 from the air supply passage of the air supply/exhaust port 42 is guided by the guide member 80 and passes the supplied-air temperature sensor 28. Accordingly, the supplied-air temperature sensor 28 enables accurate measurement of the temperature of air that has flowed into the housing 4 from the air supply passage of the air supply/exhaust port 42.

As described above, according to the combustion apparatus 202 of the present embodiment, the arrangement of the guide member 70 near the air supply passage of the air supply port 44 and the arrangement of the guide member 80 near the air supply passage of the air supply/exhaust port 42 make it possible to accurately measure the temperature of supplied air by means of the single supplied-air temperature sensor 28 both in the cases where the combustion apparatus 202 is installed in the double-pipe system shown in FIG. 5 and where it is installed in the separate-pipe system shown in FIG. 6.

While specific examples of the present invention have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present invention is not limited to the combinations described at the time the claims are filed. Further, the purpose of the examples illustrated by the present description or drawings is to satisfy multiple objectives simultaneously, and satisfying any one of those objectives gives technical utility to the present invention.

What is claimed is:

1. A combustion apparatus that can selectively be installed in a double-pipe system using a double pipe in which an exhaust pipe is accommodated in an air supply pipe or in a separate-pipe system using an exhaust pipe and an air supply pipe separately, the apparatus comprising:

an air supply/exhaust port formed such that an air supply passage surrounds the outside of an exhaust passage, and an air supply port in which an air supply passage is formed, wherein both the air supply passage of the air supply/exhaust port and the air supply passage of the air supply port communicate with the space in a housing, and wherein in a case where the apparatus is installed in the double-pipe system, the air supply passage of the air supply port is closed, whereas in a case where the apparatus is installed in the separate-pipe system, the air supply passage of the air supply/exhaust port is closed;

a supplied-air temperature sensor that measures, in the space in the housing, the temperature of supplied air; and a guide member, which is located near the air supply passage of the air supply/exhaust port or the air supply passage of the air supply port, and by which air flowing into the space in the housing from the air supply passage of the air supply/exhaust port or from the air supply passage of the air supply port is guided to the supplied-air temperature sensor, wherein the supplied-air temperature sensor is disposed near either one of the air supply passage of the air supply/exhaust port and the air supply passage of the air supply port; and wherein the guide member is disposed near the other of the air supply passage of the air supply/exhaust port and the air supply passage of the air supply port.

2. The combustion apparatus according to claim 1:

wherein the supplied-air temperature sensor is disposed near the air supply passage of the air supply/exhaust port; and wherein the guide member is disposed near the air supply passage of the air supply port.

3. A combustion apparatus that can selectively be installed in a double-pipe system using a double pipe in which an exhaust pipe is accommodated in an air supply pipe or in a separate-pipe system using an exhaust pipe and an air supply pipe separately, the apparatus comprising:

an air supply/exhaust port formed such that an air supply passage surrounds the outside of an exhaust passage, and an air supply port in which an air supply passage is formed, wherein both the air supply passage of the air supply/exhaust port and the air supply passage of the air supply port communicate with the space in a housing, and wherein in a case where the apparatus is installed in the double-pipe system, the air supply passage of the air supply port is closed, whereas in a case where the apparatus is installed in the separate-pipe system, the air supply passage of the air supply/exhaust port is closed;

a supplied-air temperature sensor that measures, in the space in the housing, the temperature of supplied air; and a guide member, which is located near the air supply passage of the air supply/exhaust port or the air supply passage of the air supply port, and by which air flowing into the space in the housing from the air supply passage of the air supply/exhaust port or from the air supply passage of the air supply port is guided to the supplied-air temperature sensor, wherein the guide member includes a bottom plate portion that blocks straight movement of air flowing into the space in the housing from the air supply passage of the air supply/exhaust port or from the air supply passage of the air supply port, and wall plate portions bent from the peripheral edges of the bottom plate portion; and wherein one of the wall plate portions has a hole or notch for guiding air to the supplied-air temperature sensor.

4. The combustion apparatus according to claim 3, wherein holes or notches for circulating air are formed around the entire periphery of the wall plate portions.

* * * * *